US009091444B2

(12) United States Patent
Turrini et al.

(10) Patent No.: US 9,091,444 B2
(45) Date of Patent: Jul. 28, 2015

(54) GAS TURBINE COMBUSTOR INJECTION ASSEMBLY, AND COMBUSTOR FUEL MIXTURE FEED METHOD

(75) Inventors: Fabio Turrini, Turin (IT); Antonio Peschiulli, Turin (IT); Marco Motta, Turin (IT)

(73) Assignee: AVIO S.p.A. (IT)

( * ) Notice: Subject to any disclaimer, the term of this patent is extended or adjusted under 35 U.S.C. 154(b) by 1076 days.

(21) Appl. No.: 13/100,761

(22) Filed: May 4, 2011

(65) Prior Publication Data

US 2011/0296840 A1 Dec. 8, 2011

(30) Foreign Application Priority Data

May 5, 2010 (IT) ..... TO2010A0378

(51) Int. Cl.
*F23R 3/14* (2006.01)
*F23R 3/28* (2006.01)
*F23R 3/12* (2006.01)

(52) U.S. Cl.
CPC . *F23R 3/286* (2013.01); *F23R 3/12* (2013.01); *F23D 2900/11101* (2013.01); *F23D 2900/14701* (2013.01)

(58) Field of Classification Search
CPC ..... F23R 3/14; F23R 3/286; F23R 3/343; F23R 3/28; F23R 3/12; F23R 3/32; F23D 2900/11101; F23C 7/004
USPC ..... 60/740, 741, 742, 746, 747, 748, 737, 60/743
See application file for complete search history.

(56) References Cited

U.S. PATENT DOCUMENTS

| | | | | |
|---|---|---|---|---|
| 3,980,233 | A * | 9/1976 | Simmons et al. | 239/400 |
| 4,766,721 | A * | 8/1988 | Iizuka et al. | 60/39.23 |
| 5,479,782 | A * | 1/1996 | Parker et al. | 60/747 |
| 6,311,496 | B1 * | 11/2001 | Alkabie | 60/748 |
| 6,345,505 | B1 * | 2/2002 | Green | 60/748 |
| 7,926,744 | B2 * | 4/2011 | Thomson et al. | 239/405 |
| 2004/0040311 | A1 | 3/2004 | Doerr et al. | |
| 2004/0250547 | A1 * | 12/2004 | Mancini et al. | 60/740 |
| 2005/0039456 | A1 * | 2/2005 | Hayashi | 60/737 |
| 2007/0169486 | A1 | 7/2007 | Hernandez et al. | |

(Continued)

FOREIGN PATENT DOCUMENTS

| | | |
|---|---|---|
| EP | 1342955 | 9/2003 |
| EP | 2171353 | 4/2010 |

(Continued)

OTHER PUBLICATIONS

European Search Report mailed Sep. 2, 2011 in EP Appln. No. 11165018.0.
Italian Search Report completed Feb. 4, 2011 in IT Appln. No. TO2010A 000378.

*Primary Examiner* — William H Rodriguez
*Assistant Examiner* — Steven Sutherland
(74) *Attorney, Agent, or Firm* — Davidson Berquist Jackson & Gowdey LLP

(57) ABSTRACT

A fuel mixture is fed to a gas turbine combustor by an injection assembly, which has an outer body with combustion-supporting air inlets; a conical tubular portion housed inside the outer body and partly defining an inner conduit and an outer annular conduit; and a first and second feed circuit for feeding liquid fuel to the inner conduit and outer annular conduit respectively; the first circuit having a ring of conduits with respective axes parallel to a generating line of an outer surface of the conical tubular portion.

9 Claims, 3 Drawing Sheets

(56) References Cited

U.S. PATENT DOCUMENTS

| | | | | |
|---|---|---|---|---|
| 2009/0212139 | A1* | 8/2009 | Thomson et al. | 239/590 |
| 2009/0301092 | A1 | 12/2009 | Wilbraham | |

FOREIGN PATENT DOCUMENTS

| | | |
|---|---|---|
| JP | 58106327 | 6/1983 |
| WO | WO 2010/037627 | 4/2010 |

* cited by examiner

GAS TURBINE COMBUSTOR INJECTION ASSEMBLY, AND COMBUSTOR FUEL MIXTURE FEED METHOD

The present invention relates to a gas turbine combustor injection assembly, and a combustor fuel mixture feed method.

More specifically, the present invention relates to an injection assembly for injecting an air-liquid fuel mixture into the combustion chamber of an aircraft/aeroderivative engine gas turbine.

BACKGROUND OF THE INVENTION

In gas turbines, the air-liquid fuel mixture is fed to the turbine combustion chamber by a fuel injection, air-fuel mixing assembly comprising a perforated combustion-supporting air inlet portion; end fuel feed pipes; and a conical tubular body, which is housed inside the perforated portion, tapers towards the combustion chamber, and has an axis extending through the combustion chamber. The conical tubular body separates two air-liquid fuel mixing conduits: an inner conduit, into which the liquid fuel is sprayed by a ring of nozzles; and an outer annular conduit, into which the liquid fuel is fed by a further ring of nozzles at a distance from the outer surface of the conical tubular body and oriented to feed the liquid fuel towards an outer wall of the annular conduit.

Before reaching the combustion chamber, the air and fuel must be mixed thoroughly, using the turbulence generated by the air.

Tests show that the location and orientation of the further ring of nozzles cannot be relied on to produce the desired mixture in all operating conditions of the combustor, and that the mixture varies according to the quantity and characteristics (e.g. density) of the airflow along the conduits. As a result, the air-liquid fuel mixture fed to the combustion chamber is not always homogeneous, by varying from one part of the conduit to another, thus resulting in the formation of fumes and large amounts of contaminating combustion products in general.

One solution comprising walls for guiding the liquid fuel in a direction substantially parallel to a generating line of the outer surface of the conical tubular portion is described, for example, in Patent Application WO2010/037627, in which the walls are housed inside the conduit into which the liquid fuel and combustion-supporting air are fed. Solutions of this sort, however, are relatively complex in design.

SUMMARY OF THE INVENTION

It is an object of the present invention to provide a gas turbine combustor injection assembly designed to provide a simple, low-cost solution to the above problem.

According to the present invention, there is provided a gas turbine combustor injection assembly comprising an outer body with combustion-supporting air inlets; a conical tubular portion housed in said outer body and partly defining an inner conduit and an outer annular conduit; and first and second feed means for feeding liquid fuel into said inner conduit and said outer annular conduit respectively; said second feed means comprising guide means for guiding the respective said liquid fuel in a direction substantially parallel to a generating line of an outer surface of said conical tubular portion; and the assembly being characterized in that said guide means are located outside said outer annular conduit.

Preferably, in the assembly defined above, said conical tubular portion has an axis, and said second feed means comprise a ring of conduits having an axis coaxial with the axis of said conical tubular portion; the conduits having respective axes parallel to said generating line.

The present invention also relates to an injection method for feeding a fuel mixture to a gas turbine combustor.

According to the present invention, there is provided a method of feeding a fuel mixture to a gas turbine combustor using an injection assembly comprising a hollow outer body, and a conical tubular portion housed in said hollow outer body and defining with it an annular conduit; the method comprising the step of feeding a stream of combustion-supporting air and at least one stream of liquid fuel into said annular conduit; and being characterized by directing said stream of liquid fuel fed into said annular conduit in a predetermined direction; intercepting said stream of liquid fuel with said stream of combustion-supporting air; and pushing the stream of liquid fuel towards said conical tubular portion by means of said stream of combustion-supporting air.

The method defined above preferably also comprises the further step of bringing and maintaining said stream of liquid fuel into/in contact with the outer surface of said conical tubular portion, and feeding it forward in contact with said conical tubular portion.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
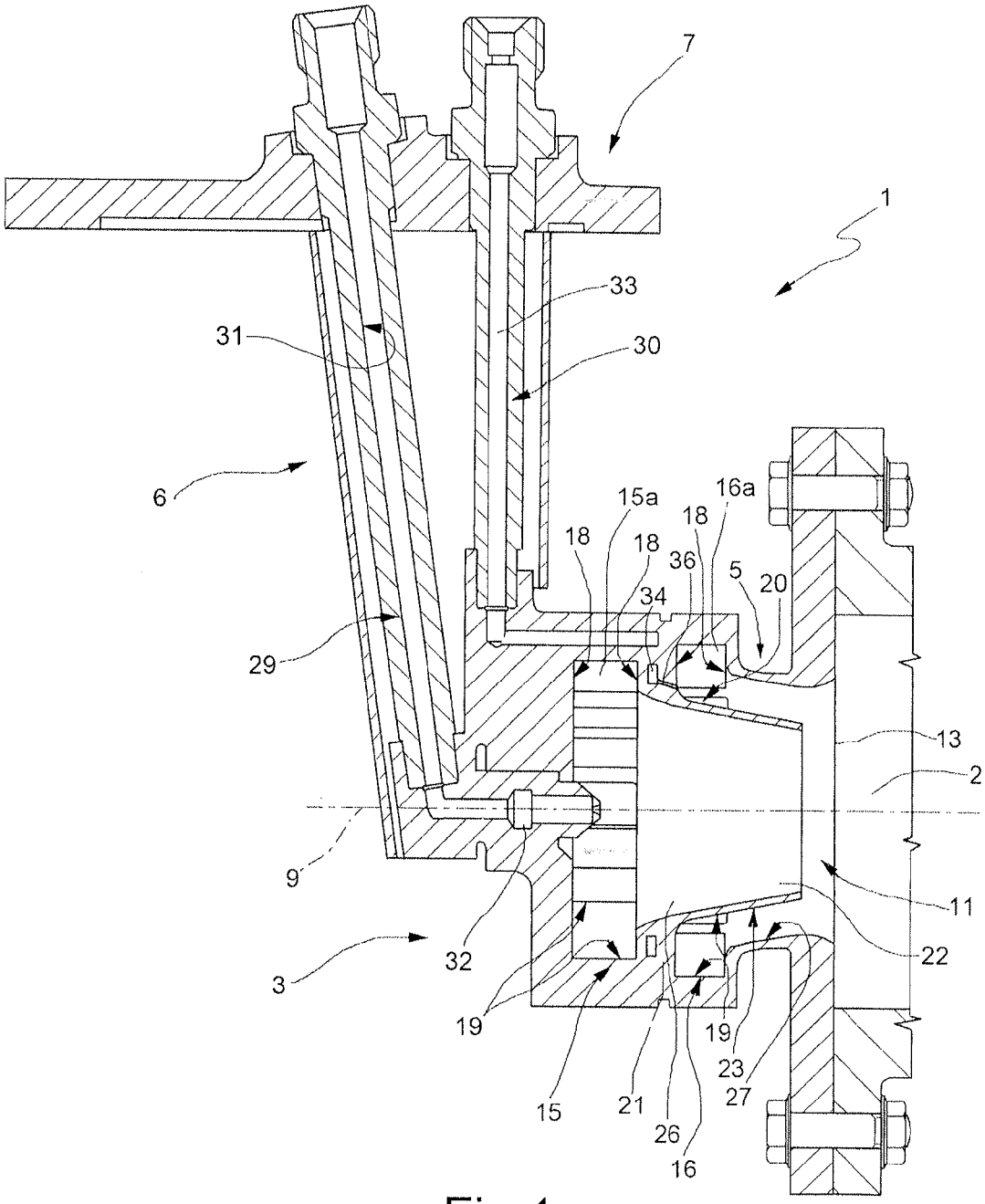
FIG. 1 shows a section, with parts removed for clarity, of a gas turbine combustor featuring a preferred embodiment of an injection assembly in accordance with the teachings of the present invention.

Number 1 in FIG. 1 indicates as a whole a combustor of a gas turbine comprising a combustion chamber 2, and an injection assembly 3 for feeding combustion chamber 2 with an air-liquid fuel mixture.

Figure 2:
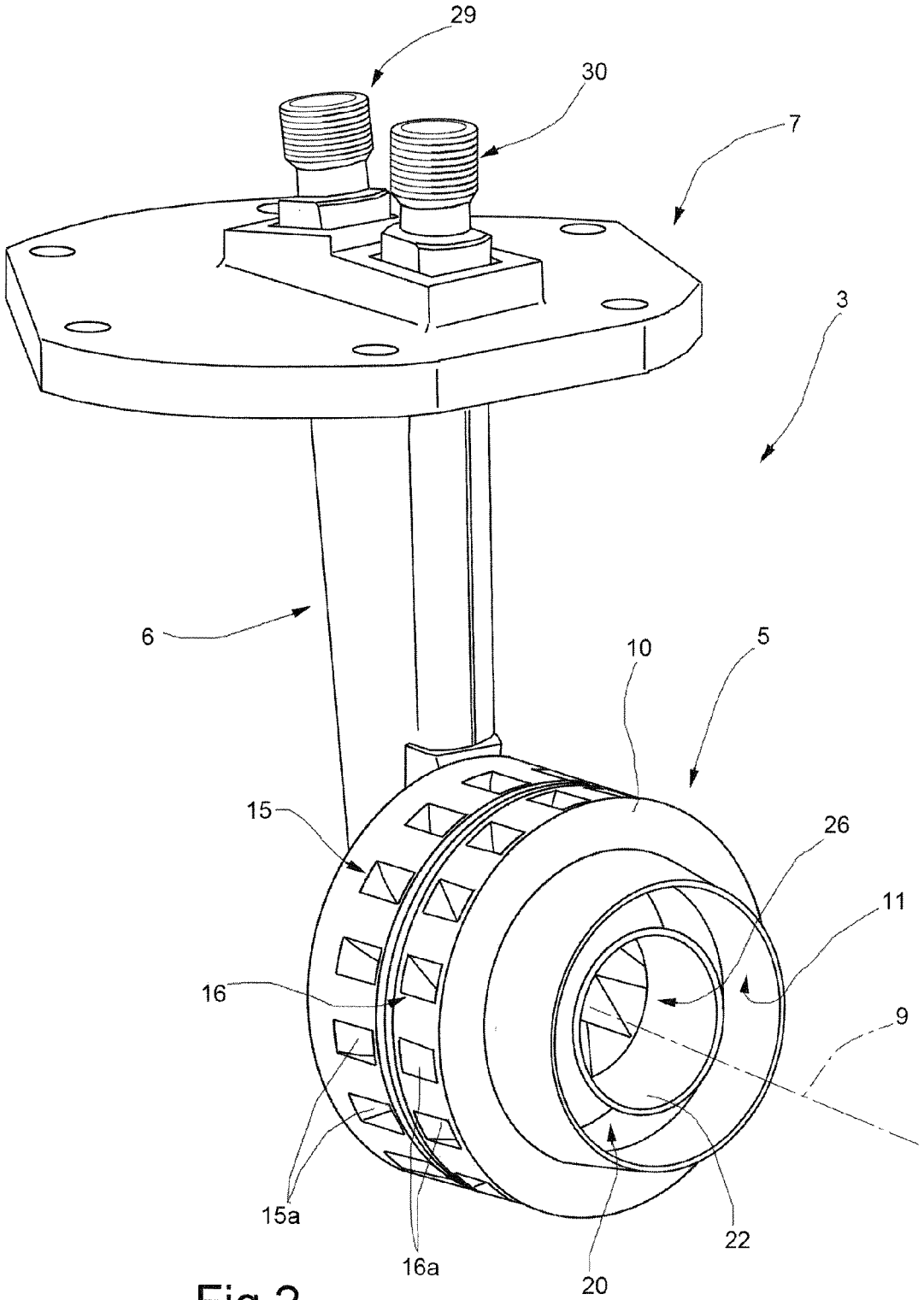
FIG. 2 shows a larger-scale view in perspective of the FIG. 1 injection assembly.

As shown in FIGS. 1 and 2, assembly 3 comprises a conveniently one-piece air-liquid fuel feed head 5; and an arm 6 supporting feed head 5 and forming, with head 5, part of a one-piece body 7.

Head 5 projects from arm 6, coaxially with an axis 9, and comprises a casing or tubular outer body 10 defining a conduit 11, which has an axial outlet 13 communicating with combustion chamber 2, and communicates externally through two adjacent rings 15, 16 of contoured opening 15*a*, 16*a*. Each opening 15*a*, 16*a* is substantially quadrangular, defines a guide for the airflow into conduit 11, is bounded axially, i.e. in the air-liquid fuel mixture flow direction, by two parallel axial walls 18 perpendicular to axis 9, and is bounded substantially circumferentially by two tangential walls 19 parallel to each other and to axis 9, and sloping radially so as to be tangent to a circle of a predetermined diameter and coaxial with axis 9, as shown in FIG. 2.

Figure 3:
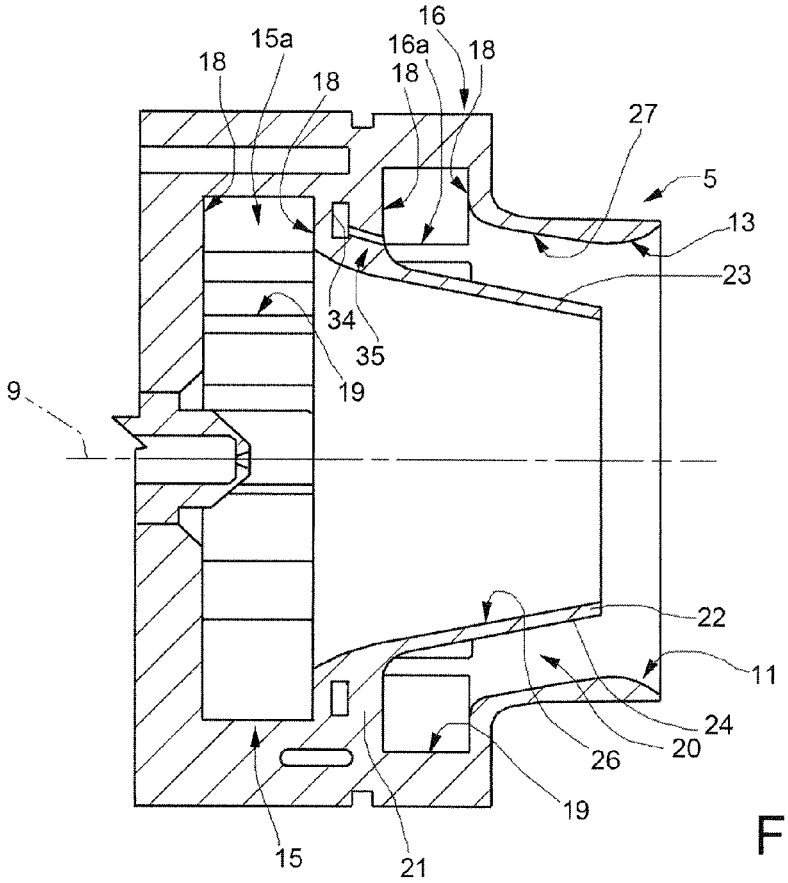
FIG. 3 shows a larger-scale section of a detail in FIG. 1.
Figure 4:
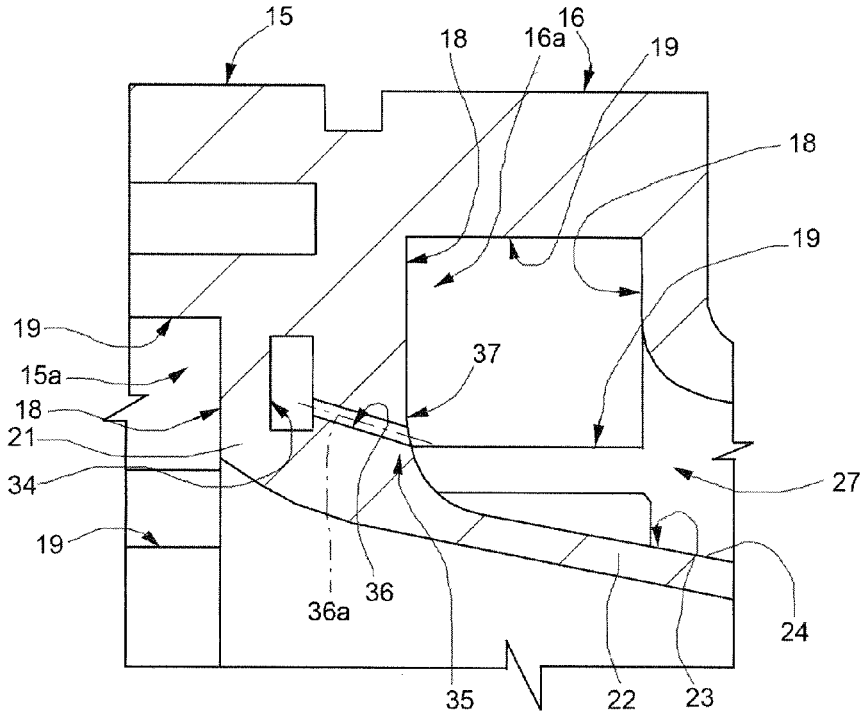
FIG. 4 shows a larger-scale section of a detail in FIG. 3.

As shown in FIGS. 1 and 3, conduit 11 houses a body 20, which is substantially T-shaped in longitudinal section and comprises a substantially plate-like annular connecting portion 21 coaxial with axis 9 and extending between rings 15 and 16. Body 20 also comprises a conical tubular portion 22, which projects from an inner edge of portion 21, coaxially with axis 9, tapers towards its free end and towards combustion chamber 2, and is bounded externally by a surface 23 having a straight generating line 24 (FIGS. 3 and 4). Body 20 divides conduit 11 into an inner conduit 26 communicating with ring 15 of openings 15*a*; and an outer annular, at least partly mixing conduit 27 bounded partly by surface 23 and communicating with ring 16 of openings 16*a*.

As shown in FIGS. 1 and 2, assembly 3 also comprises two separate hydraulic circuits 29, 30 for feeding liquid fuel to conduit 26 and annular conduit 27 respectively. Circuit 29 comprises a conduit 31 extending through arm 6; and an injector 32 located along axis 9. And circuit 30 comprises a conduit 33, the outlet of which comes out inside an annular chamber 34 formed in annular connecting portion 21 (FIGS. 3 and 4).

As shown in FIGS. 3 and 4, circuit 30 also comprises a ring 35 of straight calibrated conduits 36 extending through portion 21 and having respective axes 36*a* parallel to generating line 24. Each conduit 36 has an inlet communicating with chamber 34; and an outlet formed through a surface 37 at a distance from surface 23. Surface 37 is perpendicular to axis 9, bounds portion 21, and is coplanar with surfaces 18 of openings 16*a* in ring 16 (FIG. 4).

In use, the presence of ring 35 of conduits 36, the arrangement of conduits 36 with respect to conical tubular portion 22, and, in particular, the fact that axes 36*a* are parallel to generating line 24 of conical tubular portion 22, provide not only for directing the liquid fuel fed into annular conduit 27 towards conical tubular portion 22, but also for creating a liquid fuel film of substantially constant thickness on surface 23.

Tests show that the liquid fuel film provides not only for correct mixing of the air and liquid fuel, but also, and above all, for feeding combustion chamber 2 with a perfectly homogeneous, consistent mixture, regardless of the air and/or fuel quantities supplied by circuits 29 and 30. Mixing of the air and liquid fuel is also improved, with respect to known solutions, by the outlets of conduits 36 being formed in a surface perpendicular to axis 9 and, above all, coplanar with part of the axial surfaces bounding air inlet openings 16*a*. Unlike known solutions, the airflow into annular conduit 27 therefore intercepts and pushes the liquid fuel outflow from conduits 36 onto surface 23, at the same time producing a swirling motion inside annular conduit 27. The thrust exerted by the air causes partial evaporation of the liquid fuel inside annular conduit 27, and at the same time the remaining drops of liquid fuel deposit on surface 23 to form a film of liquid fuel, which advances along surface 23 to outlet 13, where the strong turbulence produced by the airflow from conduits 26 and 27 assists in atomizing the film before it reaches combustion chamber 2.

This results in a drastic reduction in contaminating combustion products, especially as the temperature in combustion chamber 2 increases.

Clearly, changes may be made to the assembly described without, however, departing from the protective scope as defined in the independent Claims. In particular, the guide conduits need not be perfectly parallel to generating line 24, or may be replaced by other guide means for guiding the liquid fuel in a direction substantially parallel to the generating line of the outer surface of the conical tubular portion, but still for the purpose of forming a film of liquid fuel on the outer surface.

The invention claimed is:

1. A gas turbine combustor injection assembly comprising an outer body with combustion-supporting air inlets; a conical tubular portion housed in said outer body and partly defining an inner conduit and an outer annular conduit having an outer surface defining a generating line; and first and second liquid fuel feeds feeding liquid fuel into said inner conduit and said outer annular conduit respectively;

said second liquid fuel feed comprising a fuel guide located outside said outer annular conduit and having a plurality of calibrated conduits each having an axis extending parallel to the generating line to direct liquid fuel in a direction substantially parallel to the generating line and onto the outer surface of the conical tubular portion so that a film of liquid fuel having a substantially constant thickness is formed on the outer surface, wherein said conical tubular portion has an axis, and said second liquid fuel feed comprises a ring of said plurality of calibrated conduits having an axis coaxial with the axis of said conical tubular portion; and further comprising a connecting portion connecting said conical tubular portion to said outer body; said conical tubular portion projecting axially from said connecting portion, and tapering towards its own free end; and said plurality of calibrated conduits being formed through said connecting portion.

2. The assembly as claimed in claim 1, wherein said plurality of calibrated conduits have respective outlets formed in a surface, perpendicular to said axis, of said connecting portion.

3. The assembly as claimed in claim 2, wherein said air inlets comprise respective guide portions, by which the airflow into said outer annular conduit is directed in a direction perpendicular to said axis.

4. The assembly as claimed in claim 3, wherein for each air inlet, said guide portions comprise two guide surfaces parallel to each other and to said axis, and extending substantially tangentially with respect to said conical tubular portion.

5. A method of feeding a fuel mixture to a gas turbine combustor using an injection assembly comprising a hollow outer body, and a conical tubular portion having an inwardly tapering outer surface with the tapering continuing to a free end thereof, housed in said hollow outer body and defining with it an annular conduit; the method comprising the steps of;

feeding a stream of combustion-supporting air and at least one stream of liquid fuel into said annular conduit;

directing said stream of liquid fuel fed into said annular conduit outwardly through a plurality of conduits each having an axis parallel to a generating line of the tapering outer surface of the conical tubular portion and thus in a predetermined direction so as to be parallel with and onto the tapering outer surface of the conical tubular portion;

intercepting said stream of liquid fuel with said stream of combustion-supporting air; and pushing the stream of liquid fuel towards and onto the tapering outer surface of the conical tubular portion by the stream of combustion-supporting air thereby creating a liquid fuel film of a substantially constant thickness on the tapering outer surface of the conical tubular portion.

6. The method as claimed in claim 5, including the further step of bringing and maintaining said stream of liquid fuel into/in contact with the outer surface of said conical tubular portion, and feeding the liquid feed forward in contact with said conical tubular portion.

7. The method as claimed in claim 6, including the step of at least maintaining said stream of liquid fluid in contact with said outer surface is achieved by generating at least one air vortex outwards of said film of liquid fuel.

8. The method as claimed in claim 5, including the step of forming a film of liquid fuel on said outer surface.

9. The method as claimed in claim 5, wherein said stream of liquid fuel entering said annular conduit is guided in a direction substantially parallel to the generating line of the outer surface of said conical tubular portion.

* * * * *